US006958575B2

(12) United States Patent
Dombrowski et al.

(10) Patent No.: US 6,958,575 B2
(45) Date of Patent: Oct. 25, 2005

(54) METAL HALIDE LAMP WITH IMPROVED RED RENDITION AND CRI

(75) Inventors: Kevin S. Dombrowski, Painted Post, NY (US); Claudia Alicia Rojas-Cedillo, Shanghai (CN)

(73) Assignee: Koninklijke Philips Electronics N.V., Eindhoven (NL)

( * ) Notice: Subject to any disclaimer, the term of this patent is extended or adjusted under 35 U.S.C. 154(b) by 96 days.

(21) Appl. No.: 10/024,770

(22) Filed: Dec. 20, 2001

(65) Prior Publication Data

US 2003/0117061 A1 Jun. 26, 2003

(51) Int. Cl.[7] ..... H01J 1/62; H01J 63/04

(52) U.S. Cl. ..... 313/489; 313/493; 313/634

(58) Field of Search ..... 313/489, 493, 313/634, 292, 239, 25

(56) References Cited

U.S. PATENT DOCUMENTS

| | | | | |
|---|---|---|---|---|
| 5,572,091 A | * | 11/1996 | Langer et al. | 313/636 |
| 5,961,208 A | | 10/1999 | Karpen | 362/510 |
| 6,136,736 A | * | 10/2000 | Rajaram et al. | 501/54 |
| 6,157,131 A | * | 12/2000 | Nelson et al. | 313/634 |
| 6,294,871 B1 | | 9/2001 | Scott et al. | 313/636 |
| 6,329,742 B1 | * | 12/2001 | Nelson et al. | 313/25 |

FOREIGN PATENT DOCUMENTS

| | | | |
|---|---|---|---|
| EP | 05094804 | 4/1993 | |
| EP | 1174905 A1 | 1/2002 | |
| WO | WO0011704 | 3/2000 | H01J/61/34 |
| WO | WO0075958 | 12/2000 | H01J/61/34 |
| WO | 01/24224 | 4/2001 | |

* cited by examiner

*Primary Examiner*—Joseph Williams
*Assistant Examiner*—Kevin Quarterman

(57) ABSTRACT

A ceramic metal halide arc tube is surrounded by a protective neodymium sleeve supported by a metal frame. As a result of the neodymium sleeve, the lamp is observed to have improved transmission of red color and to exhibit a CRI of at least about 90.

12 Claims, 2 Drawing Sheets

METAL HALIDE LAMP WITH IMPROVED RED RENDITION AND CRI

BACKGROUND OF THE INVENTION

The invention relates to a lamp of the type having a protective sleeve surrounding a light source, in particular a metal halide arc tube having a pair of opposed leads. The sleeve is supported by a metal frame comprising a pair of metal frame members which also supply current to the leads.

Protective sleeves of quartz or other transparent material able to withstand operating temperatures are commonly utilized around metal halide arc tubes, also known as high intensity discharge or HID arc tubes, in order to provide protection against non-passive failure during lamp operation. These sleeves act to slow or stop fast moving arc tube fragments and prevent the rupture of the outer lamp envelope. These sleeves may also provide other functions including, but not limited to, reduction of the UV output of the lamp. Typical examples of such lamps may be found in U.S. Pat. No. 6,157,131 issued Dec. 5, 2000 and U.S. Pat. No. 6,329,742 issued Dec. 11, 2001, both assigned to the assignee in this application. These patents are addressed primarily to unique mounting characteristics for particular lamp designs which position a sleeve over the arc tube of the lamp for the purpose of containment protection if the tube ruptures or is ruptured. Such ceramic discharge metal halide lamps using a sleeve as a means of protection and exhibiting a color temperature of about 3000K, usually exhibit a color rendering index (CRI) in the low 80's.

There is a continued need in the art for protected ceramic discharge metal halide lamps that exhibit an improved color rendering index, and in particular for protected ceramic discharge metal halide lamps that exhibit a color temperature of about 3000K and an improved color rendering index.

SUMMARY OF THE INVENTION

It is an object of the invention to provide a lamp having a protective sleeve around a light source, in particular a ceramic metal halide arc tube, that exhibits a color temperature of about 3000K and an improved color rendering index.

It is a further object to provide a lamp having a protective sleeve around a light source such as a ceramic metal halide arc tube, that exhibits a color temperature of about 3000K and a color rendering index of about 90 or above.

According to the invention, these and other objects are attained in a lamp comprising a light source having a pair of opposed leads, a protective sleeve around the light source, said sleeve having an upper end and a lower end, and a metal frame supporting said sleeve, wherein the protective sleeve comprises neodymium.

We have found that by using a protective sleeve which comprises neodymium or consists of or is composed of or has a coating of neodymium on at least a substantial portion of its surfaces or is doped with neodymium, it is possible to transmit mostly red colors resulting in a product with a much larger and improved CRI when compared to conventional lamps with conventional sleeves that are devoid of neodymium. Thus the sleeve may consist of neodymium, or a substantial portion of the sleeve may comprise neodymium, or the neodymium may be coated on surfaces of the sleeve, or the sleeve may comprise transmissive glass or quartz doped with neodymium. Particularly preferred are sleeves that consist of neodymium or alternatively, neodymium-doped Vycor. Vycor is a glass available commercially from Corning.

The particular sleeve may be formed and supported in the lamp structure by any of several ways well known in the art as long as it is predominantly comprised or composed or consists of neodymium or has a coating of neodymium on at least a substantial portion of its surfaces.

DETAILED DESCRIPTION OF THE PREFERRED EMBODIMENT

Figure 1:
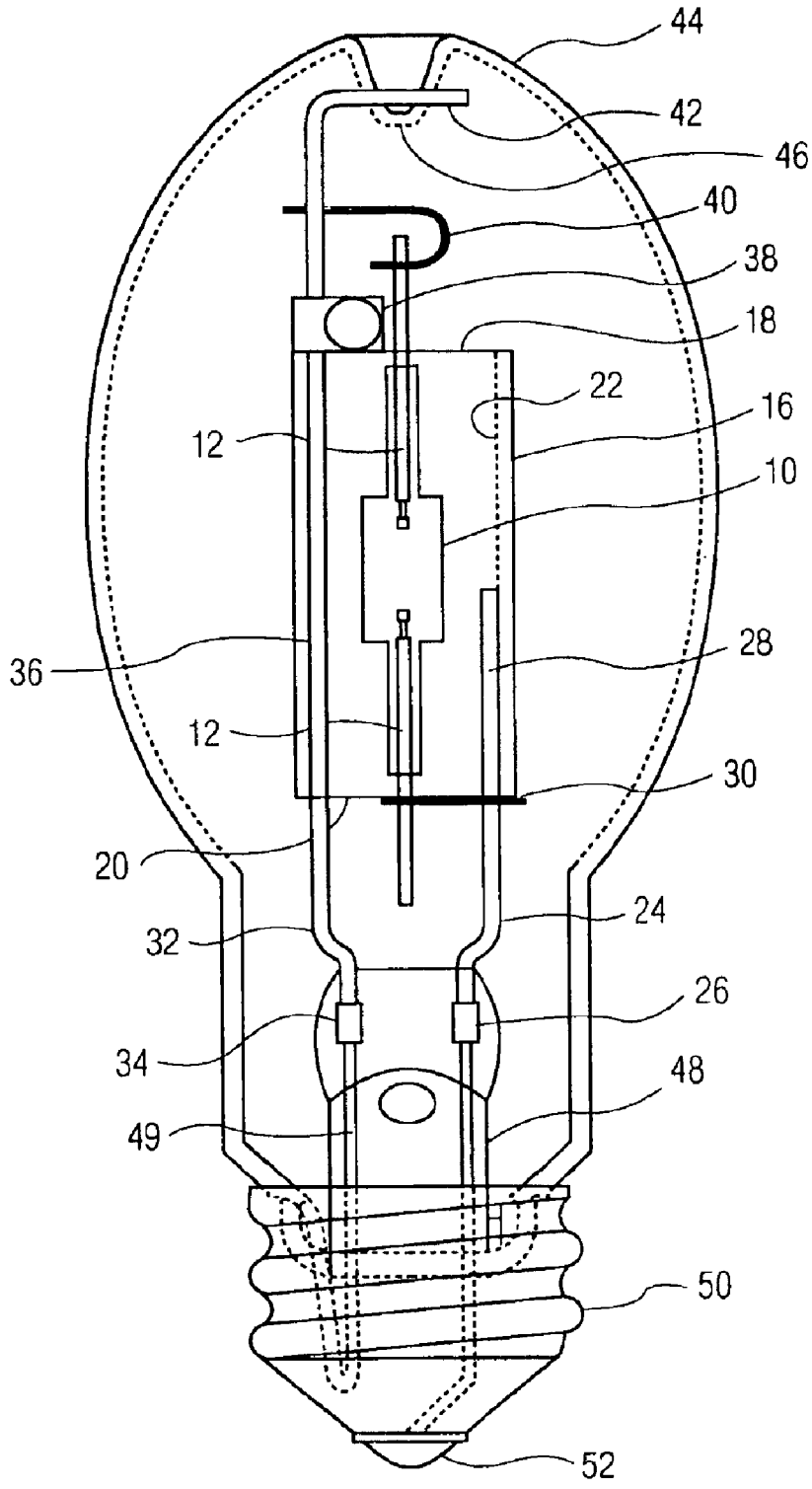
FIG. 1 is an elevation view of a lamp according to the invention.

Referring to FIG. 1, a lamp according to the invention includes a light source formed by a metal halide arc tube 10 having a having a pair of opposed leads 12 surrounded by a protective sleeve 16 of neodymium. The tubular sleeve has an upper end 18, and oppositely facing lower end 20, and an internal surface 22 extending between the ends.

The neodymium sleeve is supported by a frame member by means known in the art. In the embodiment illustrated in FIG. 1, the sleeve is supported by a short frame member 24 and a long frame member 32, both of which are received inside the sleeve 16 and spring loaded outward against the internal surface thereof. The frame members are preferably formed with stainless steel wire, however, molybdenum, niobium, Ni-plated iron, or any other suitable wire may be used. The short frame member has a lower end embedded in the stem 48 formed integrally with the glass envelope 44, a straight portion 28 which bears against the internal surface 22, and a welded-on terminal 30 which provides an electrical connection to the lower arc tube lead 12, and supports one end 20 of the neodymium sleeve 16. The long frame member 32 has a lower end 34 embedded in the glass stem 48 and a straight section 36 extending through the length of the sleeve 16 and bearing against internal surface 22. Optionally, a getter 38 may be fixed to the member 32 and bears against the upper end 18 of the neodymium sleeve 16 and serves to fix its position. A terminal 40 provides an electrical connection for the upper arc tube lead 12. Beyond this the frame member 32 is provided with an integrally formed loop 42 which fits around a dimple 46 formed in the upper end of the glass envelope 44. The lower ends 26, 34 of the frame members are welded to leads 49 on which the glass stem 48 is formed. The sleeve 16 is then fitted onto the frame members 24, 32 by sliding onto the upper end thereof without any straps or clips outside of the frame members being necessary. The subassembly is then fitted into the glass envelope 44 with loop 42 about dimple 46. The stem 48 is then sealed to the glass envelope and exhausted, the base 50 is fitted, and the insulated contact 52 is fitted. This construction is basically as disclosed and claimed in said U.S. Pat. No. 6,157,131 referred to above.

Alternatively, the ceramic metal halide arc tube may be supported by any of means well known in the art; for example, the arc tube may be surrounded by a protective sleeve supported by a metal frame having current wire frame members brazed into the metal ferrules of a PAR lamp wherein each frame member has an integral engaging means such as an S-shaped bend and a spacer as described and claimed in U.S. Pat. No. 6,329,742. Other means of support will be well apparent to those skilled in the art.

Figure 2:
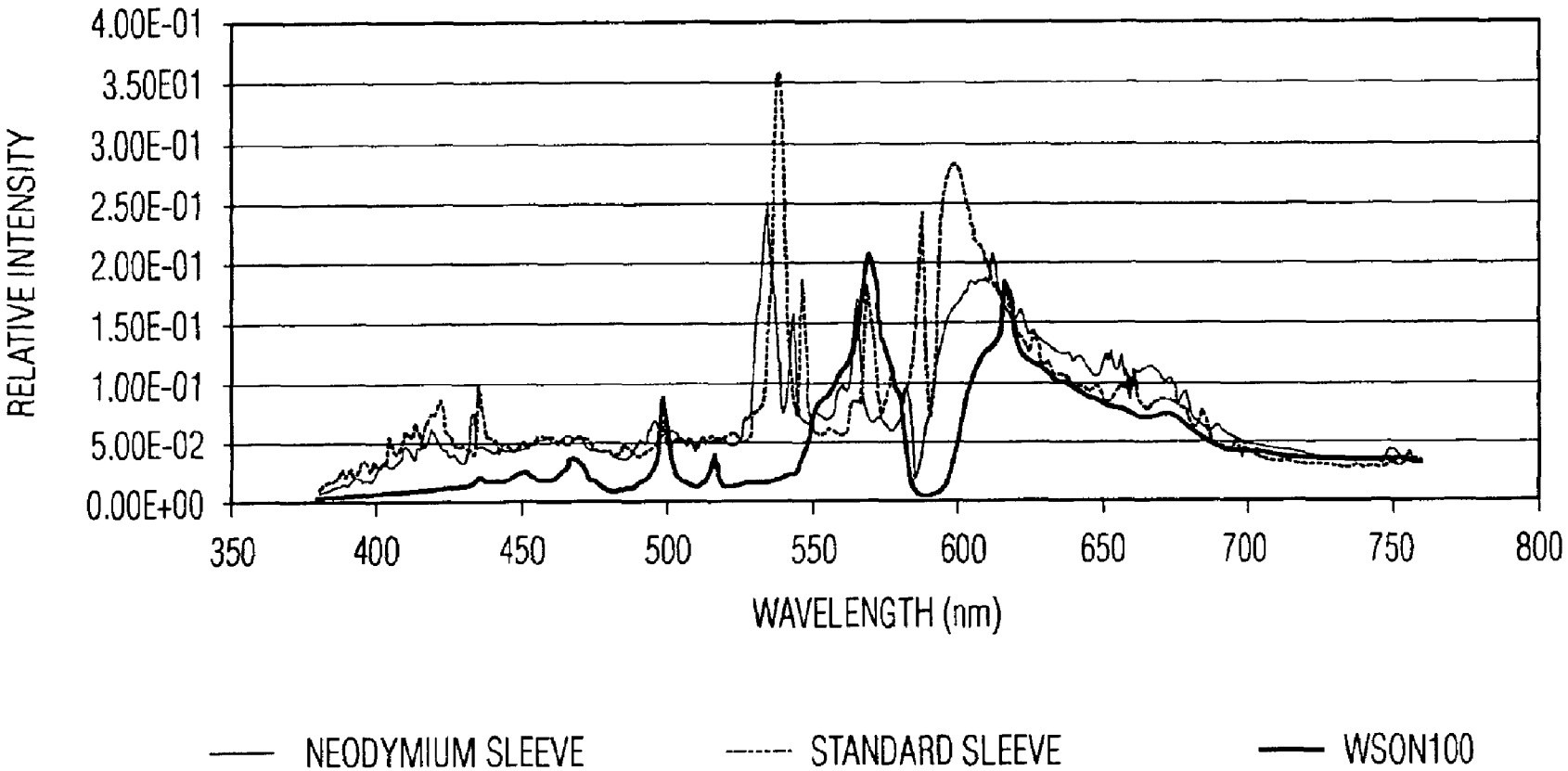
FIG. 2 is a graph illustrating the wavelength intensity distribution of a lamp of the invention.

With reference to FIG. 2, it will be apparent that lamps with a neodymium protective sleeve according to the invention show a reduction (filtering) of the Na or yellow transmission and an increase in the red contribution for the visible spectrum. This provides a more incandescent-like, "warm" appearance with excellent red saturation.

To better illustrate the invention, lamps of the invention and prior art were analyzed to determine spectral power distribution data compared to several lamps of the prior art by measuring the CRI exhibited and the amount of color transmitted in the red frequency band (the "R" value).

Actual measured data was obtained of the spectral components for three individual lamps described below. The wavelength intensity distribution of the respective lamps is illustrated in FIG. 2.

Lamp 1 was a Philips "White SON" (WSON) lamp that exhibits a color temperature of about 2700K and is known for its excellent reds, i.e. the amount and quality of the color transmitted in the red frequency band. This lamp had a CRI of approximately 80, and an R-9 value of 64.4. WSON (HID) lamps are noted for their incandescent-like "warm color" characteristics and excellent red transmission and operate at one-third the energy consumption of incandescent lamps. This is achieved by use of an integral ballast and controller circuit.

Lamp 2 was a standard CDM protected lamp with a color temperature of about 3000K, CRI of 85, and an R-9 value of 7.7. CDM or Ceramic Discharge Metal Halide lamps are best noted for their excellent color rendering properties as compared to previous Quartz discharge MH lamps. These lamps contain a cerium doped quartz sleeve to provide containment protection and reduction in UV output.

Lamp 3 illustrates a lamp included in the present invention and was a CDM lamp that exhibits a color temperature of about 3000K and comprises a neodymium-doped Vycor sleeve. This lamp had a CRI of 91.1 and an R-9 value of 92.7. In addition to the improvements in red rendition and CRI, this lamp offers a 15–20% improvement in efficiency as compared to the WSON lamp, and importantly, it is suitable for same-power retrofit applications. Therefore, it may be used with most existing ballast and fixture systems and is thus more economical than lamps, which require special ballasts and control circuits.

It will be understood that the invention is applicable to any of several constructions known in the art, the improved red transmission and CRI improvements being obtained as a result of the neodymium sleeve and not because of the manner in which the sleeve is mounted in the lamp.

The foregoing is exemplary and not intended to limit the scope of the claims which follow. While the present invention has been described in particular detail, it should also be appreciated that numerous modifications are possible within the intended spirit and scope of the invention. In interpreting the appended claims it should be understood that where and if it appears:

a) the word "comprising" or "comprises" does not exclude the presence of other elements than those listed in a claim;

b) the word "consisting" excludes the presence of other elements than those listed in a claim;

c) the word "a" or "an" preceding an element does not exclude the presence of a plurality of such elements.

d) any reference signs in the claims do not limit their scope; and e) several "means" may be represented by the same item of hardware or software implemented structure or function.

What is claimed is:

1. A lamp comprising a light source having a pair of opposed leads, a protective sleeve around the light source, and a metal frame supporting said sleeve, wherein the protective sleeve is composed of neodymium.

2. A lamp as claimed in claim 1 which exhibits a color temperature of about 3000K.

3. A lamp as claimed in claim 1 which exhibits a color temperature of about 3000K and a color rendering index of about 90 or above.

4. A lamp comprising a light source formed by a metal halide arc tube, a protective sleeve around the light source, and a metal frame supporting said sleeve, wherein the protective sleeve is composed of neodymium.

5. A lamp as in claim 4 which exhibits a color temperature of about 3000K and an improved color rendering index of at least about 90.

6. A lamp as in claim 4 which exhibits a color temperature of about 3000K and an improved red transmission and a color rendering index of about 90 or above.

7. A lamp as claimed in claim 4, wherein:

the light source is a ceramic metal halide arc tube having a pair of opposed leads surrounded by a protective sleeve of neodymium; the tubular sleeve has an upper end, and oppositely facing lower end, and an internal surface extending between the ends; and the neodymium sleeve is supported by a frame member;

the lamp further comprising an insulating member fixed between said frame members above said upper end of said sleeve, whereby said light source, said frame members, said sleeve, and said insulating member form a rigid self-supporting structure.

8. A lamp comprising a light source formed by a metal halide arc tube, a protective sleeve around the light source, said sleeve having a pair of opposed ends, a metal frame supporting said sleeve, and a glass envelope surrounding the light source, the protective sleeve, and the metal frame, wherein the protective sleeve around the light source comprises an effective amount of neodymium to result in an improved CRI when compared to conventional lamps with sleeves that are devoid of neodymium.

9. A lamp as claimed in claim 8, wherein the protective sleeve is a transparent, high-temperature material selected from quartz doped with neodymium and Vycor doped with neodymium.

10. A lamp as claimed in claim 8, wherein the protective sleeve is a transparent, high-temperature material selected from quartz on which a film of neodymium has been applied and Vycor on which a film of neodymium has been applied.

11. A lamp as claimed in claim 8, wherein said protective sleeve comprises a coating of neodymium on at least a substantial portion of its surfaces.

12. A lamp as claimed in claim 8, wherein:

the light source is a ceramic metal halide arc tube having a pair of opposed leads surrounded by said protective sleeve comprising neodymium; the tubular sleeve has an upper end, and oppositely facing lower end, and an internal surface extending between the ends; and the neodymium sleeve is supported by a frame member; the lamp further comprising an insulating member fixed between said frame members above said upper end of said sleeve, whereby said light source, said frame members, said sleeve, and said insulating member form a rigid self-supporting structure.

* * * * *